US005207337A

United States Patent [19]

Massey

[11] Patent Number: 5,207,337

[45] Date of Patent: May 4, 1993

[54] SWING CONTROLLED CRANE

[76] Inventor: Navarre A. Massey, Box 1299 Spring Point Rd., Fort Macleod, Alberta T0L 0Z0, Canada

[21] Appl. No.: 948,246

[22] Filed: Sep. 21, 1992

[51] Int. Cl.[5] ..... B66C 23/18

[52] U.S. Cl. ..... 212/249; 212/179

[58] Field of Search ..... 212/179, 180, 241, 244, 212/245, 246, 247, 248, 249, 254

[56] References Cited

U.S. PATENT DOCUMENTS

| | | | |
|---|---|---|---|
| 1,485,011 | 2/1924 | Beatty | 254/337 |
| 2,433,921 | 1/1948 | Nelson | 254/337 |
| 2,509,950 | 5/1950 | Zierke | 212/280 |
| 3,774,788 | 11/1973 | Sowers et al. | 212/179 |
| 3,945,502 | 3/1976 | Diener | 212/179 |
| 4,269,396 | 5/1981 | Easterwood | 212/177 |
| 4,961,604 | 10/1990 | Kisner | 212/180 |

*Primary Examiner*—Sherman Basinger
*Assistant Examiner*—Thomas J. Brahan
*Attorney, Agent, or Firm*—George H. Dunsmuir

[57] ABSTRACT

A portable crane includes a bracket mounted on a shaft extending upwardly from bearings on the vehicle; a boom extending outwardly from the bracket, a spool rotatable in the bracket carrying a cable, which extends outwardly around a pulley, a hook on the outer end of the cable for supporting a load, and a pair of slack adjusters, one of which receives the shaft for rotating the latter and consequently the boom between use and transport positions, the other slack adjuster engaging the spool for rotating the latter to wind the cable thereon.

5 Claims, 3 Drawing Sheets

SWING CONTROLLED CRANE

This invention relates to a portable crane.

While the crane of the present invention was designed specifically for use on a small truck, it will be appreciated that the crane can be used on other vehicles or even on a bench or other fixed position while remaining portable.

In general, vehicle mounted cranes tend to be somewhat complicated and consequently expensive contrivances. Most such devices rely on hydraulic cylinders and yards of hose for feeding fluid to and from the cylinders. A need exists for a portable crane, which can be mounted on a conventional pick-up truck.

The object of the present invention is to meet the above defined need by providing a relatively simple portable crane, which is free of hydraulics and which is easy to construct.

Accordingly, the present invention relates to a portable crane comprising bracket means; post means carrying said bracket means for rotatably mounting the bracket means on a support; boom means on said bracket means; spool means rotatable in said bracket means for carrying a cable; first slack adjuster means on said post means for rotating the post means and consequently the bracket means and boom means between use and non-use positions; and second slack adjuster means for rotating said spool means to wind the cable on said spool means.

The invention will be described in greater detail with reference to the accompanying drawings, which illustrate a preferred embodiment of the invention, and wherein.

Figure 1:
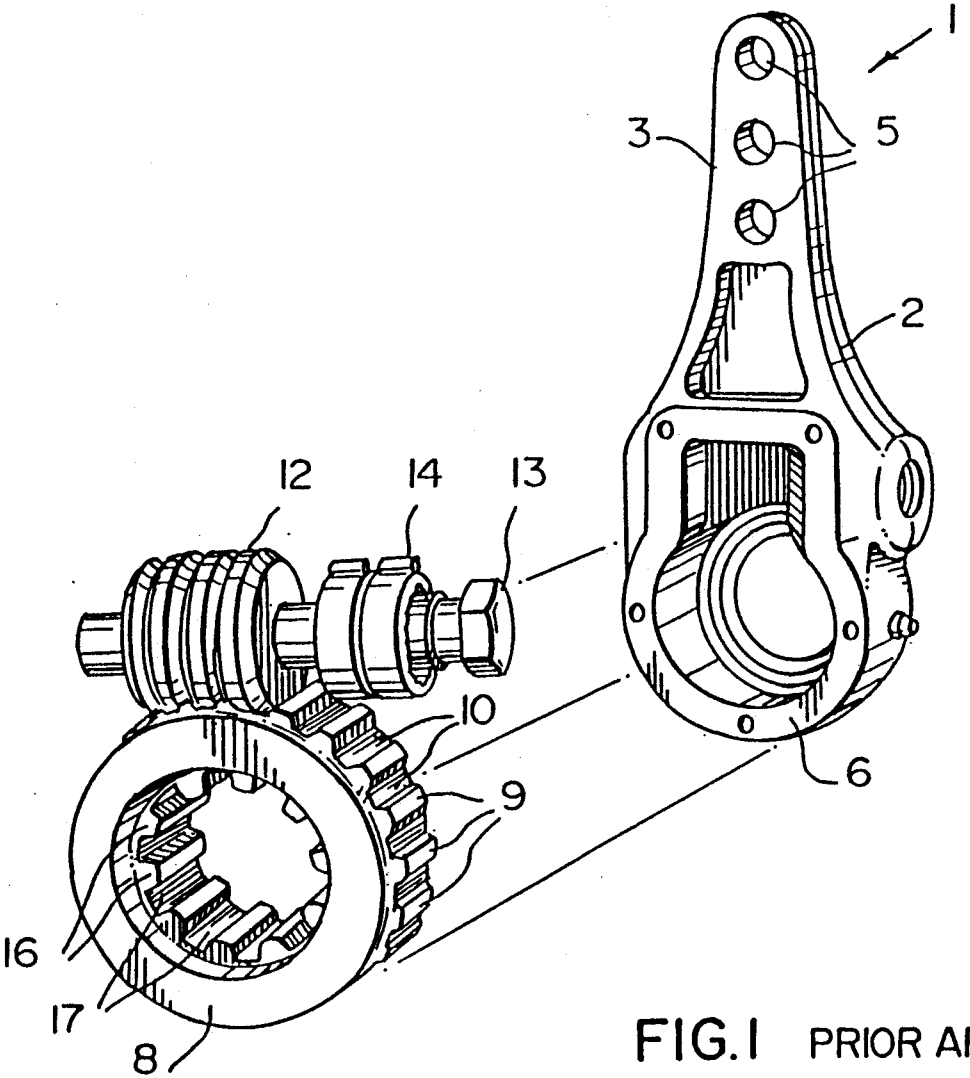
FIG. 1 PRIOR ART
FIG. 1 is a schematic, exploded, isometric view of a slack adjuster for use in the crane of the present invention.
Figure 2:
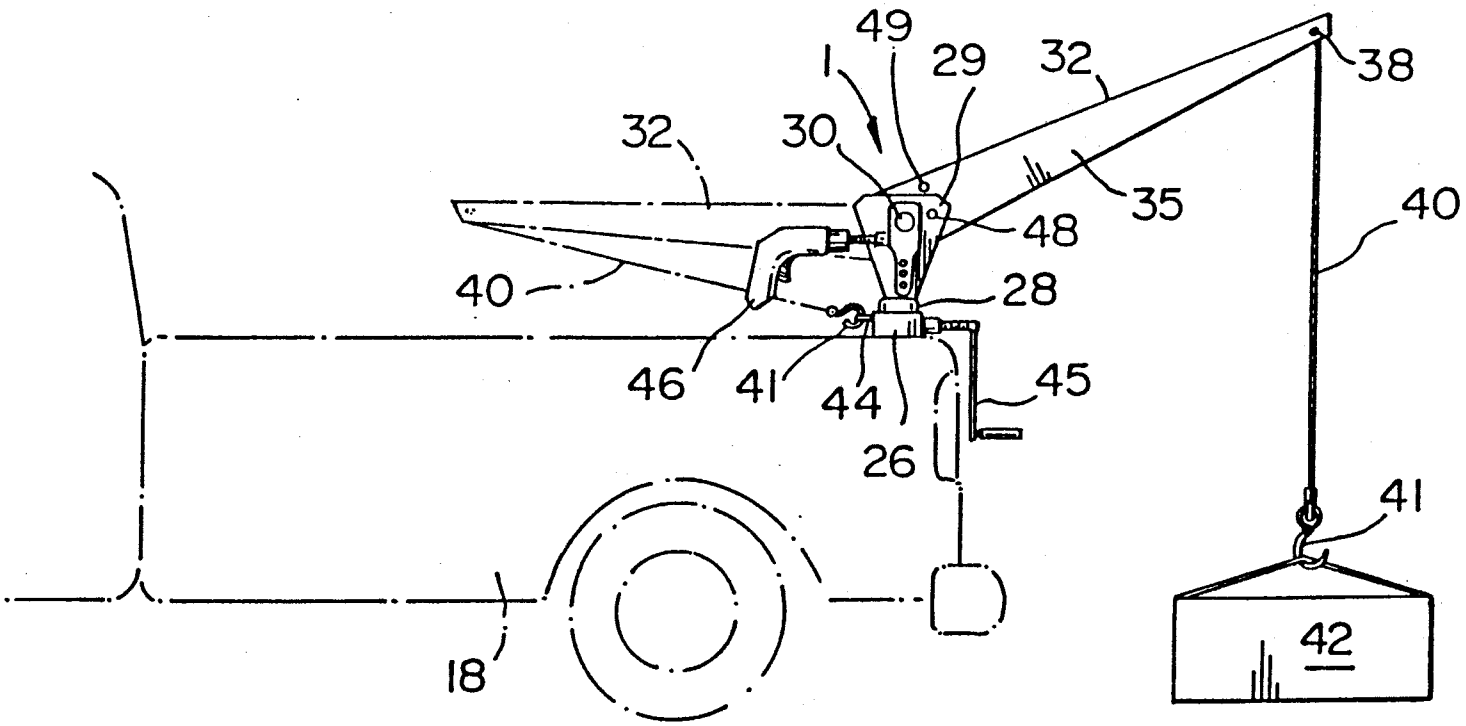
FIG. 2 is a schematic, side elevation view of a crane in accordance with the present invention.
Figure 3:
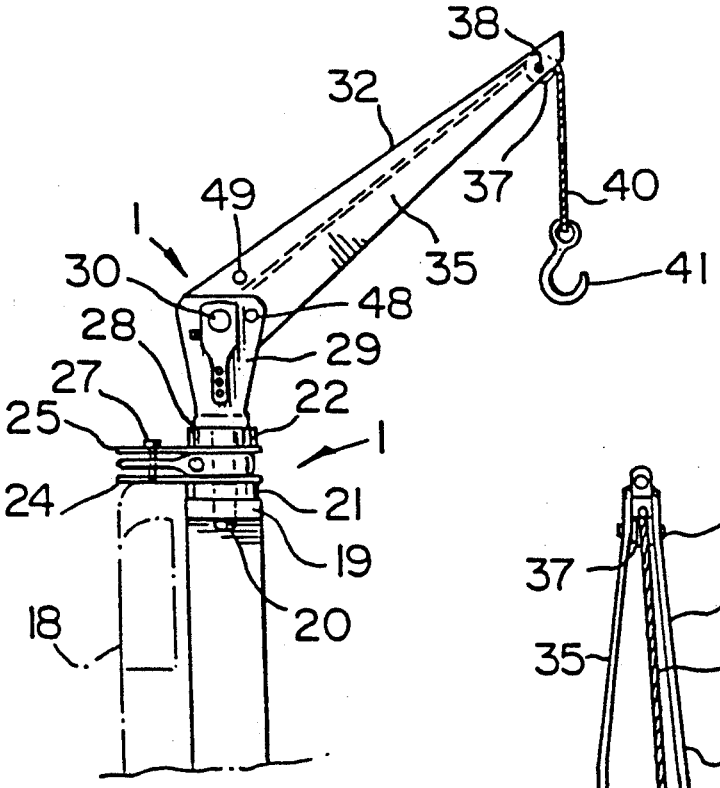
FIG. 3 is an end elevation view of the crane of FIG. 2.

Referring to FIG. 1, the basic element of the crane of the present invention is an off-the-shelf slack adjuster generally indicated at 1. The slack adjuster 1, which is available from Brunner-Fleet Products, is similar to the device described in U.S. Pat. No. 2,156,154, which issued to H. H. Hooker on Apr. 25, 1939. The slack adjuster includes an elongated body 2 with a tapering end 3. A row of openings 5 are provided in the end 3. The openings 5 are normally used to connect the slack adjuster to a vehicle brake (not shown) for adjusting the latter. The other end 6 of the body 7 defines a casing for an annular gear 8 with alternating external splines 9 and grooves 10. The splines 9 and 10 are used to connect the gear 8 to a worm 12, which is connected to a bolt 13 by a coupler 14. Thus, the bolt 13 is in driving connection with the worm 12. Normally, the gear 8 is locked in one position by a releasable brake (not shown) in the slack adjuster. Rotation of the bolt 13 is required to effect a corresponding rotation of the gear 8. Alternating splines 16 and grooves are also provided on the interior of the gear 8. As shown in FIGS. 2 and 3, the slack adjuster is used in two locations in the crane. The crane is mounted on the back of a truck 18 where it is supported by a ledge or frame 19. The crane includes a mast defined by a splined shaft or post 20 extending through collars or sleeves 21 and 22, and the frame 19. The sleeve 21 is mounted on the frame 19 beneath a plate 24. A slack adjuster 1 is mounted between the plate 24 and a second plate 25 (FIG. 3). As shown in FIG. 2, the plates 24 and 25 can form part of a box or casing 26 for the slack adjuster 1. The slack adjuster 1 is retained in a fixed position by a bolt 27 extending through the plates 24 and 25. The post 20 extends downwardly from a bearing plate 28 rotatably mounted on the sleeve 22.

Figure 4:
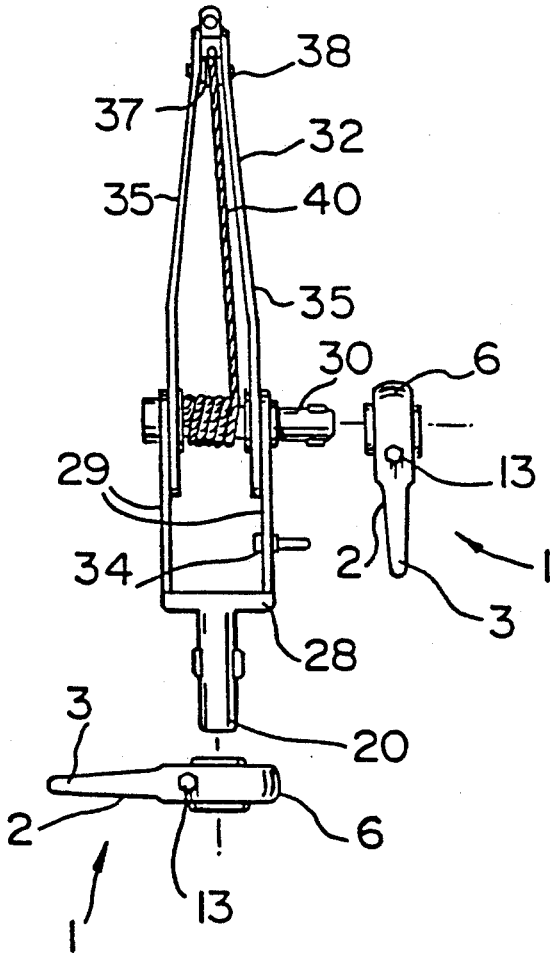
FIG. 4 is an exploded end view of a bracket and a boom used in the crane of FIGS. 2 and 3.

The plate 28 carries two parallel, upwardly extending polygonal plates 29, which define the sides of a bracket supporting a second splined shaft 30 and a boom 32. The second slack adjuster 1 is mounted vertically on the exterior of one side plate 29 of the bracket. A pin 34 (FIG. 4) extends through the plate 29 and one of the holes 5 in the end 3 of the slack adjuster 1 to hold the latter in a fixed position. Whereas, the post 20 supporting the first slack adjuster 1 is splined in the central area thereof, the second shaft 30 is splined at the outer end for fixedly engaging the interior of the gear 8.

The boom 32 is defined by a pair of outwardly tapering sides 35, which converge towards their interconnected outer ends. A pulley 37 is rotatably mounted on a pin 38 extending between the boom sides 35 close to the outer ends thereof. A cable 40 wound on the portion of the shaft 30 between the sides 35 extends around the pulley 37. Thus, the shaft 30 acts as a trunnion or pivot for the boom 32 and as a spool for the cable 40. A hook 41 for engaging a load 42 (FIG. 2) is carried by the outer free end of the cable 40. A loop 44 on one side of the top plate 25 holds the hook 41 in the non-use or transport position shown in phantom outline in FIG. 2.

The bolts 13 on the slack adjusters are rotated using a manual socket wrench 45 or an electrically operated wrench 46. Of course, a pneumatic socket wrench could also be used. Actuation of the horizontal slack adjuster 1 rotates the post 20 and consequently the boom 32 between the non-use or transport position shown in phantom outline in FIG. 2, and the use position shown in solid lines in FIGS. 2 and 3. Actuation of the second, vertical slack adjuster 1 causes rotation of the shaft or spool 30 to raise or lower a load 42.

The level of the boom 32 can be changed by rotating the arms 35 around the longitudinal axis of the shaft 30. In order to retain the boom 32 in one position a pin (not shown) is inserted through aligned holes 48 and 49 in the sides 29 of the bracket and in the arms 35, respectively. While only one hole is shown in the bracket sides 29 and the arms 35, it will be appreciated that there would normally be two set of holes 40 and 49 for releasably retaining the boom in the two positions shown in FIG. 2.

The crane can be used on a vehicle, or installed at a fixed location such as on a shop bench. Operation of one slack adjuster 1 rotates the boom 32 between the non-use position shown in phantom outline in FIG. 2 and the use position shown in solid lines in FIG. 2. Actuation of the other slack adjuster 1 causes winding of the cable 40 onto or from the spool to raise or lower a load 42.

THE EMBODIMENTS OF THE INVENTION IN WHICH AN EXCLUSIVE PROPERTY OR PRIVILEGE IS CLAIMED ARE DEFINED AS FOLLOWS:

1. A portable crane comprising bracket means; post means carrying said bracket means for rotatably mounting the bracket means on a support; boom means on said bracket means; spool means rotatable in said bracket means for carrying a cable; first slack adjuster means on said post means for rotating the post means and consequently the bracket means and boom means between use and non-use positions; and second slack adjuster means for rotating said spool means to wind the cable on said spool means.

2. A portable crane according to claim 1, wherein said boom means includes a pair of spaced apart first sides pivotally mounted on said spool means for receiving the cable therebetween; and first pin means for releasably latching said first sides in an elevated, use position or a lower, non-use position.

3. A portable crane according to claim 2, including second pin means for securing said first slack adjuster means in a fixed position on the support; and third pin means for securing said second slack adjuster in a fixed position on said bracket means.

4. A portable crane according to claim 3, wherein said bracket means includes a pair of spaced apart second sides carrying said spool means and said first sides of the boom means, and said second slack adjuster on an exterior surface of one said second side.

5. A portable crane according to claim 4, wherein said first pin means extends through at least one said first and second sides in the latching position.

* * * * *